US005505247A

United States Patent [19]

Musschoot

[11] Patent Number: 5,505,247

[45] Date of Patent: Apr. 9, 1996

[54] CASTING PROCESS AND SYSTEM

[75] Inventor: Albert Musschoot, Barrington, Ill.

[73] Assignee: General Kinematics Corporation, Barrington, Ill.

[21] Appl. No.: 65,275

[22] Filed: May 21, 1993

[51] Int. Cl.[6] ..... B22D 45/00; B22C 19/04

[52] U.S. Cl. ..... 164/76.1; 164/154.6; 164/456; 164/131; 164/269

[58] Field of Search ..... 164/401, 404, 164/131, 132, 5, 4.1, 456, 154.6, 154.1, 269, 270.1, 76.1, 458, 155.1

[56] References Cited

U.S. PATENT DOCUMENTS

| | | | |
|---|---|---|---|
| 3,335,861 | 8/1967 | Musschoot et al. | 164/404 |
| 4,209,055 | 6/1980 | Bühler | 164/456 |
| 4,211,274 | 7/1980 | Slowinski et al. | 164/401 |
| 4,231,414 | 11/1980 | Wallwork | 164/401 |
| 4,747,444 | 5/1988 | Wasem et al. | 164/155.2 |
| 5,054,538 | 10/1991 | Ibsen | 164/269 |
| 5,253,698 | 10/1993 | Keough et al. | 164/269 |

FOREIGN PATENT DOCUMENTS

| | | | |
|---|---|---|---|
| 2908861 | 9/1980 | Germany | 164/269 |
| 3323839 | 1/1985 | Germany | 164/269 |
| 57-50236 | 3/1982 | Japan | 164/456 |
| 58-84667 | 5/1983 | Japan | 164/404 |
| 9219410 | 12/1984 | Japan | 164/404 |
| 0077014 | 5/1985 | Japan | 164/404 |

*Primary Examiner*—Richard K. Seidel
*Assistant Examiner*—James Miner
*Attorney, Agent, or Firm*—Wood, Phillips, VanSanten, Clark & Mortimer

[57] ABSTRACT

In order to effectively enhance the overall efficiency in casting operations, a process and system for cooling and cleaning a casting is disclosed. The process and system include removing the casting from a molding machine after it has been formed. The casting is then moved to a punch-out station for removing it from a sand mold. Next, the casting is moved to a shake-out station for shaking residual sand from it. The casting is then conveyed away from the shake-out station on a cooling conveyor. Next, the temperature of the casting is monitored at or near a downstream end of the cooling conveyor. The casting is then transferred from the cooling conveyor into a vibratory cooling drum where it is further cooled. In addition to these unique aspects, the process and system includes controlling the rate of cooling of the casting within the vibratory cooling drum.

45 Claims, 1 Drawing Sheet

CASTING PROCESS AND SYSTEM

FIELD OF THE INVENTION

The present invention is generally related to casting processes and systems and, more particularly, a process and system for cooling and cleaning a casting.

Generally speaking, the processes and systems for the casting of metals can be divided into two principal categories. The first of these involves casting with expendable molds, e.g., sand casting whereas the second category involves the utilization of permanent molds which can be reused a large number of times. In either case, it will be understood that it is necessary to initially make a model of the casting to be produced.

As is well recognized, the model is called a "pattern" in the field of founding, and the mold is then produced from the pattern which may, by way of example, be formed of wood, plaster, metal, plastics and the like. With the exception of very simple castings, the pattern will generally include two or more parts, i.e., the actual pattern as well as the core or cores which will form the cavities and recesses in the casting.

In casting with expendable molds, the molding materials used for constructing the actual molds in which the metal will be cast are usually mineral substances such as sand. The sand, along with bonding agents, give the molds the necessary strength and dimensional accuracy. Moreover, with the bonding agents which are commonly used, the bonding action may be achieved, depending upon the materials, by either drying or chemical consolidation (curing).

In dry sand molding, it is generally known that the mold is baked whereas in green sand molding, the mold is typically utilized with sand in a damp, or "green" condition. The metal is then poured either into an open mold or through a system of channels in a closed mold. When the metal has solidified, the casting is removed from the mold, it then undergoes additional cooling, and the casting is finally cleaned by abrasive blasting, tumbling or the like.

Where the casting is an automotive cylinder block, it has been known that the cooling system or process is most unsatisfactory. It has commonly required an overhead cooling conveyor where the castings are partially cooled in a very slow five to six hour time span over a distance of approximately 1500 meters. Moreover, maintenance and repair that are involved in this system or process have represented a heavy burden for the foundry.

Still additionally, the requirement for complementary equipment such as brushes, shake-out devices and shot blasting machines, have taken up unacceptably large amounts of valuable foundry space.

The present invention is directed to overcoming one or more of the foregoing problems and achieving one or more of the resulting objects.

SUMMARY OF THE INVENTION

It is a principal object of the present invention to provide an improved process and system for cooling and cleaning a casting. It is still an additional object of the present invention to provide such a process and system where cooling can be performed in a more efficient and effective manner than in the past. It is a further object of the present invention to provide a computer controlled process and system for any type of cylinder block casting.

Accordingly, the present invention is directed to a process and system for cooling and cleaning a casting which includes removing the casting from a molding machine after it has been formed. The casting is then moved to a punch-out station for removing it from a sand mold. Next, the casting is moved to a shake-out station for shaking residual sand from the casting. The casting is then conveyed away from the shake-out station on a cooling conveyor. Next, the casting temperature is monitored at or near a downstream end of the cooling conveyor. The casting is then transferred from the cooling conveyor into a vibratory cooling drum for cooling. Still additionally, the process includes the step of controlling the rate of cooling of the casting within the vibratory cooling drum.

In a preferred form of the invention, the temperature monitoring includes receiving a temperature signal indicative of the temperature of the casting at or near the downstream end of the cooling conveyor. Advantageously, the casting transfer also includes introducing molding sand from a point upstream of the cooling conveyor into the vibratory cooling drum with the casting. Preferably, the cooling rate control then includes adding moisture to sand within the vibratory cooling drum responsive to a signal indicative of the moisture in the sand.

In other respects, the conveying of the casting preferably includes exhausting air from an upstream end of the cooling conveyor and blowing air onto a downstream end of the cooling conveyor. Similarly, cooling rate control preferably includes exhausting air from a downstream end of the vibratory cooling drum at a point just upstream of a molding sand return port therein.

In an exemplary form of the invention, the cooling rate control includes generating a thermocouple signal from each of a plurality of locations within the vibratory cooling drum. It also preferably includes adding moisture to sand within the vibratory cooling drum at each of a plurality of locations therewithin. As for the temperature monitoring, it preferably includes receiving an infrared signal indicative of temperature at a point just beyond the downstream end of the cooling conveyor.

Advantageously, the molding sand including sand from the shake-out station are conveyed to the vibratory cooling conveyor along a path which is independent of the casting. Separating the sand from the casting results in more efficient cooling of the casting and thus reducing the possibility of inducing stresses and possible cracking of the casting. When this is done, a scale signal is generated which is indicative of molding sand weight at a point downstream of the shake-out station and upstream of the vibratory cooling drum.

In a most highly preferred application of the invention, the process and system is designed and particularly well suited for cooling and cleaning an engine casting. The cooling rate control advantageously includes the generation of a sand moisture signal from each of a plurality of locations within the vibratory cooling drum at which locations moisture is added to sand responsive to the signals. In this connection, the cooling rate control further advantageously includes processing the scale, temperature and sand moisture signals to control moisture addition to the sand.

In this preferred application of the invention, the process and system may further include transferring the engine casting from the vibratory cooling drum to a shot blast station at a point downstream thereof.

Preferably, the engine casting is at a temperature of approximately 1250° F. to 1350° F. and the molding sand is at a temperature of approximately 250° F. at the punch-out station. It is also advantageous to move the engine casting from the punch-out station to a soft shake-out station for shaking residual sand from the casting and later moving the casting to a core shake-out station at a point downstream of the cooling conveyor and upstream of the vibratory cooling drum. As for other parameters, the sand temperature at the core shake-out station is approximately 800° F. and the engine casting temperature just upstream of the vibratory cooling drum is approximately 1000° F. Casting temperature upstream of the cooling drum should be stable so that rapid cooling can be performed without inducing high stresses in the casting which can cause cracking of the casting.

In a most highly preferred application of the invention, the engine casting is removed from the vibratory cooling drum at a temperature of approximately 130° F. and the sand is removed from the vibratory cooling drum at a temperature of approximately 120° F. with a moisture content of approximately 1.5%.

Other objects, advantages and features of the present invention will become apparent from a consideration of the following specification taken in conjunction with the accompanying drawings.

DETAILED DESCRIPTION OF THE PREFERRED EMBODIMENTS

Figure 1:
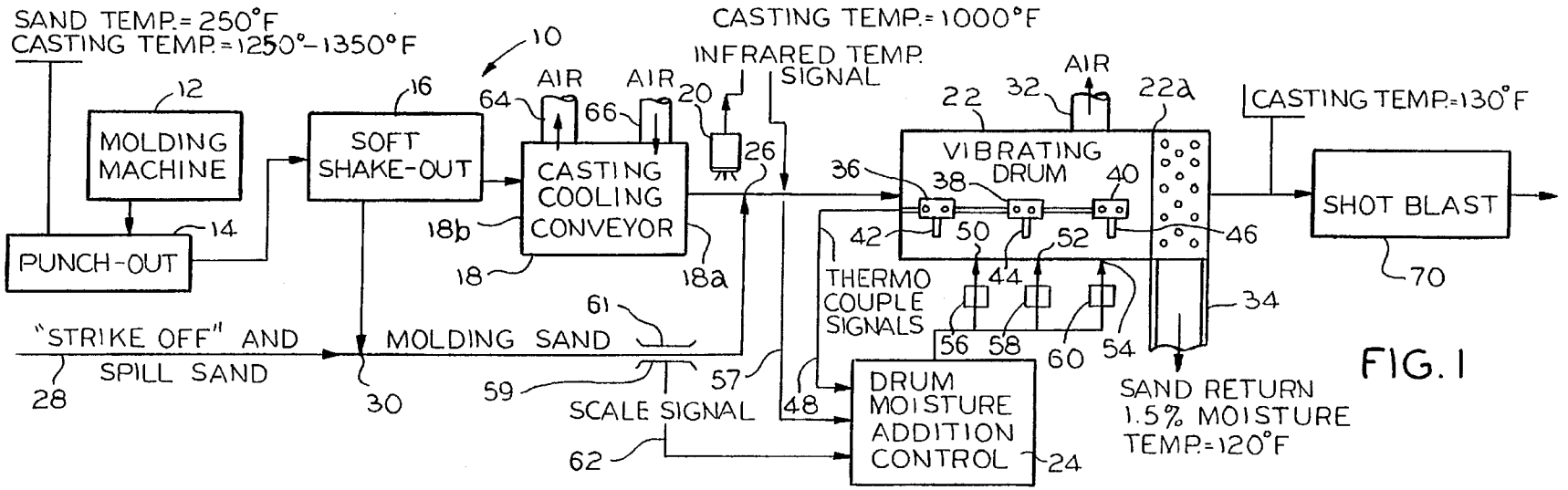
FIG. 1 is a schematic view illustrating a process and system for cooling and cleaning a casting in accordance with the present invention.

In the illustrations given, and with reference first to FIG. 1, the reference numeral 10 designates generally a schematic representation of a process and system for cooling and cleaning a casting in accordance with the present invention. It includes removing the casting from a molding machine 12 after it has been formed, moving the casting to a punch-out station 14 for removing it from a sand mold, moving the casting to a shake-out station 16 for shaking residual sand from the casting, and conveying the casting away from the shake-out station 16 on a cooling conveyor 18. In addition, the process and system includes monitoring the temperature of the casting as at 20 at a point at or near a downstream end 18*a* of the cooling conveyor 18 following which it is transferred into a vibratory cooling drum 22.

More specifically, the process and system includes transferring the casting from the cooling conveyor 18 into the vibratory cooling drum 22 for further cooling of the casting. It will also be understood that the process and system 10 includes controlling the rate of cooling of the casting within the vibratory cooling drum 22. For this purpose, a drum moisture addition control device 24 may be utilized to add moisture to sand within the vibratory cooling drum 22 responsive to a signal indicative of the moisture in the sand.

Still referring to FIG. 1, the temperature monitoring is achieved by receiving a temperature signal as at 20 indicative of the temperature of the casting at or near the downstream end 18*a* of the cooling conveyor 18. It will also be seen and understood that the process and system include introduction of molding sand as at 26 from a point upstream of the cooling conveyor 18 into the vibratory cooling drum with the casting by means of a conveyor 28 which carries "strike off" and spill sand as well as sand received as at 30 from the shake-out station 16. As mentioned, the cooling rate control includes adding moisture to sand within the vibratory cooling drum 22 by means of the drum moisture addition control device 24 responsive to a signal indicative of the sand moisture.

With this understanding of the process and system 10, the cooling rate control may also advantageously include the exhausting of air as at 32 from a downstream end 22*a* of the vibratory cooling drum 22 at a point just upstream of a molding sand return port 34 therein.

In the exemplary embodiment, the cooling rate control includes generating a thermocouple signal from each of a plurality of locations 36, 38 and 40 within the vibratory cooling drum 22. These signals are advantageously generated by sensors 42, 44, and 46 which transmit their respective signals by means of a signal conveying line 48 which is in communication with the drum moisture addition control device 24 substantially as shown. As will also be seen, the cooling rate control includes adding moisture to sand within the vibratory cooling drum 22 at each of a plurality of locations 50, 52 and 54.

In this connection, the moisture is advantageously added by means of appropriate fluid control valves 56, 58, and 60 that are suitably controlled by the drum moisture addition control device 24. These valves can, thus, open to add moisture to the sand within the vibratory cooling drum 22 at one or more of the locations 50, 52 and 54 depending upon the thermocouple signals received from the sensors 42, 44, and 46 which measure sand moisture content. Since the sand moisture content is dependent upon the temperature of the sand and casting, this is advantageous in controlling the rate of cooling of the sand and casting as they pass through the vibratory cooling drum 22.

As previously mentioned, the temperature monitoring is preferably achieved by receiving a temperature signal as at 20 indicative of the temperature of the casting at or near the downstream end 18*a* of the cooling conveyor 18. This signal is preferably an infrared signal which is also transmitted to the drum moisture addition control device 24 by means of a signal conveying line such as 57. Still additionally, the process and system 10 includes the generation of a scale signal as at 59 which is indicative of the molding sand weight downstream of the shake-out station 16 and upstream of the vibratory cooling drum 22.

With this understanding of the process and system 10, the cooling rate of the casting is suitably controlled by processing the scale, temperature and sand moisture signals to control moisture addition to the sand. Thus, it will be appreciated that the scale signal is transmitted from a scale as at 61 (which is positioned along the path of the "strike off", spill, and shake-out sand as it is conveyed toward the vibratory cooling drum 22) to the drum moisture addition control device 24 by means of a signal carrying line 62 where, along with sand moisture and temperature signals transmitted by lines 48 and 57, respectively, the drum moisture addition control device 24 can control moisture addition to the sand in the vibratory cooling drum 22 and, thus, control cooling of the casting therewithin. And as previously mentioned, air can be exhausted as at 32 from, at or near the downstream end 22*a* of the vibratory cooling drum 22 to further control the cooling rate of the casting therewithin.

While not previously mentioned, the process and system may include exhausting air as at 64 from an upstream end 18*b* of the cooling conveyor 18 and blowing air as at 66 onto a downstream end 18*a* of the cooling conveyor 18. This pattern of air circulation relative to the cooling conveyor 18 also serves to reduce the temperature of the casting as it passes from the shake-out station 16 to the vibratory cooling drum 22. As will be appreciated, all of these various cooling techniques cooperate in order to achieve the intended objective of cooling the casting most expeditiously without cracking or other damage thereto.

In the embodiment of the invention which is illustrated in FIG. 1, the casting is at a temperature of approximately 1250° F. to 1350° F. and the molding sand is at a temperature of approximately 250° F. at the punch-out station 14. It will also be seen that the casting may suitably enter the vibratory cooling drum 22 at a temperature of approximately 1000° F. Still additionally, the casting and sand may be removed from the vibratory cooling drum 22 at temperatures of approximately 130° F. and approximately 120° F., respectively, with the sand having a moisture content of approximately 1.5%.

Figure 2:
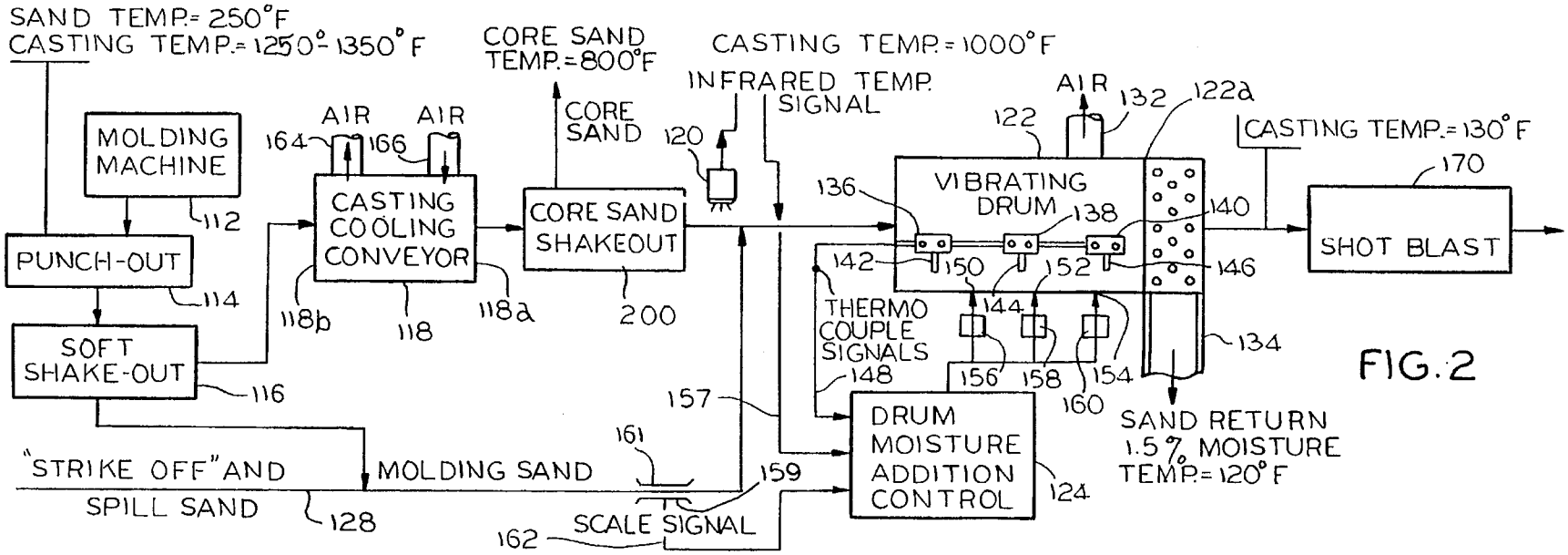
FIG. 2 is a schematic view illustrating a process and system similar to that illustrated in FIG. 1 which is especially suited for use with engine castings.

Referring to FIG. 2, the process and system 110 will be seen and understood to be generally quite similar to the process and system 10 illustrated and described in connection with FIG. 1. It includes the same basic steps and equipment by which a casting passes from a molding machine 112 to a punch-out station 114 and, from there, to a soft shake-out station 116 and onto a casting cooling conveyor 118 which preferably has air exhausted as at 164 at an upstream end 118*b* and blown onto the cooling conveyor as at 166 at a downstream end 118*a* thereof. As will also be seen, the molding sand including "strike off", spill and shake-out sand pass along a conveyor 128 to be introduced along with the casting into the vibratory cooling drum 122.

While the process and system 10 illustrated in FIG. 1 is entirely satisfactory for almost any application, the process and system 110 is particularly well suited for utilization with engine castings. FIG. 2 includes an additional step of moving the engine casting, which will typically comprise a cylinder block, to a sand core shake-out station 200 at a point downstream of the cooling conveyor 118 and upstream of the vibratory cooling drum 122. The sand temperature at the core shake-out station 200 is approximately 800° F. and, likewise, the engine casting temperature is approximately 800° F. as it enters the vibratory cooling drum 122. As will be appreciated, the process and system 110 causes the temperature of the casting to be monitored as at 120 which temperature is conveyed by a line 148 to a drum moisture addition control device 124.

Also, as before, the process and system 110 includes the generation of thermocouple signals as at 136, 138, and 140 by means of sensors 142, 144, and 146 which are conveyed to the drum moisture addition control device 124 through the line 148. These thermocouple signals, along with the infrared temperature signal conveyed by means of the line 156 and the scale signal as at 159 from the scale 157 conveyed by means of the line 162, are all processed by the drum moisture addition control device 124. When the signals have been processed, the drum moisture addition control device 124 controls the valves 156, 158, and 160 for selectively introducing moisture as at 150, 152, and 154 into the sand in the vibratory cooling drum 122 to control the cooling rate of the engine casting.

As in FIG. 1, the vibratory cooling drum 122 may also advantageously include an air exhaust 132, a molding sand return port 134, and all other details thereof.

With this understanding, the process and system 110 may also serve to reduce the temperature of the engine casting as it exits the downstream end 122*a* of the vibratory cooling drum 122 to 130° F. with the sand temperature being reduced to 120° F. and having a moisture content of approximately 1.5%.

In both FIG. 1 and FIG. 2, the casting can then be introduced into a shot blast which may be continuous or selectively activated for further cleaning as at 70 and 170, respectively.

While not previously discussed in detail, it will be appreciated that the present invention is particularly suited for cooling a casting below a temperature of criticality to avoid cracking. The latter can be a serious problem, particularly if the casting comes into contact with moisture at an elevated temperature. The critical temperature will vary depending on metal being cast. All portions of the casting should be below critical temperature so that rapid cooling, as in the cooling drum, will not cause undesirable stresses that can induce crackings In addition, since the moisture is added in an entirely controlled fashion, the casting is not only efficiently and effectively cooled but the sand is homogenized and cooled as well.

It will be appreciated that the drum moisture addition control device will comprise a computerized control system. It will include a processing unit for suitably processing the data in the form of the signals which are transmitted to it from the various sensors and the like. In this manner, the cooling of the casting in the vibratory cooling drum can be controlled as required to achieve rapid completion of the cooling process.

In an experimental application, the time for cooling a casting from the point of removal from a molding machine to the point of transfer into a vibratory cooling drum was approximately 36 minutes. This time was found suitable for keeping all stress levels within production limits and, moreover, the subsequent desired temperature drop within the vibratory cooling drum was achieved in approximately 10 minutes in a drum length of approximately 12 meters. In the vibratory cooling drum, the castings will be understood to rotate within a rather thick layer of sand conveyed to the drum by a conveying belt from the upstream equipment.

By reason of the probes and thermocouples in the drum, an exclusive moisture control system is achieved. Moisture is always added to the sand in the vibratory control drum, never to the surface of the castings themselves. Once cooled, the castings are subjected to shot blast and the sand is returned into the system.

Preferably, the vibratory cooling drum will take the form of the drums disclosed in my commonly owned U.S. Pat. Nos. 4,926,601, granted on May 22, 1990 and Re. 33,542, granted on Feb. 26, 1991, the teachings of which are incorporated herein by reference for better understanding the present invention.

With the present invention, it has been possible to eliminate many pieces of equipment requiring high maintenance costs. It is also possible with the invention to cast any type of cylinder block without modifying cooling times and casting path. Still additionally, the present invention requires no manual assistance since it is entirely controlled by a computer.

While in the foregoing there have been set forth preferred embodiments of the invention, it will be appreciated that the details herein given may be varied by those skilled in the art without departing from the true spirit and scope of the appended claims.

I claim:

1. A process for cooling and cleaning a casting, comprising the steps of:

removing said casting from a molding machine after said casting has been formed in said molding machine;

moving said casting to a punch-out station for removing said casting from molding sand of a sand mold;

moving said casting to a shake-out station for shaking residual sand from said casting;

conveying said casting away from said shake-out station on a cooling conveyor;

conveying said molding sand and said residual sand on a separate path away from said shake-out station;

monitoring the temperature of said casting at or near a downstream end of said cooling conveyor;

transferring said casting from said cooling conveyor and the sand from the sand conveyor into a vibratory cooling drum for cooling said casting and said sand; and controlling the rate of cooling of said casting and said sand within said vibratory cooling drum.

2. The casting cleaning and cooling process of claim 1 wherein said conveying step includes exhausting air from an upstream end of said cooling conveyor and blowing air onto a downstream end of said cooling conveyor.

3. The casting cleaning and cooling process of claim 1 wherein said monitoring step includes receiving a temperature signal indicative of the temperature of said casting at or near said downstream end of said cooling conveyor.

4. The casting cleaning and cooling process of claim 1 wherein said controlling step includes adding moisture to sand within said vibratory cooling drum responsive to a signal indicative of the moisture in said sand.

5. The casting cleaning and cooling process of claim 1 wherein said controlling step includes exhausting air from a downstream end of said vibratory cooling drum at a point just upstream of a molding sand return port therein.

6. A process for cooling and cleaning a casting, comprising the steps of:

removing said casting from a molding machine after said casting has been formed in said molding machine;

moving said casting to a punch-out station for removing said casting from a sand mold;

moving said casting to a soft shake-out station for shaking residual molding sand from said casting;

conveying said casting away from said shake-out station on a cooling conveyor;

monitoring the temperature of said casting at or near a downstream end of said cooling conveyor including receiving a temperature signal indicative of the temperature of said casting at or near said downstream end of said cooling conveyor;

transferring said casting from said cooling conveyor into a vibratory cooling drum for cooling said casting and introducing molding sand from said soft shake out station into said vibrators cooling drum with said casting;

controlling the rate of cooling of said casting within said vibratory cooling drum including adding moisture to sand within said vibratory cooling drum responsive to a signal indicative of the moisture in said sand;

conveying said molding sand including sand from said soft shake-out station to said vibratory cooling drum independent of said casting; and generating a scale signal indicative of molding sand weight downstream of said soft shake-out station and upstream of said vibratory cooling drum.

7. A process for cooling and cleaning a casting, comprising the steps of:

removing said casting from a molding machine after said casting has been formed in said molding machine;

moving said casting to a punch-out station for removing said casting from molding sand of a sand mold;

moving said casting to a soft shake-out station for shaking residual molding sand from said casting;

conveying said casting away from said shake-out station on a cooling conveyor;

conveying said molding sand along a separate path away from said shake-out station on a sand conveyor;

monitoring the temperature of said casting at or near a downstream end of said cooling conveyor including receiving a temperature signal indicative of the temperature of said casting at or near said downstream end of said cooling conveyor;

transferring said casting from said cooling conveyor into a vibratory cooling drum for cooling said casting and introducing molding sand from said sand conveyor into said vibratory cooling drum with said casting; and controlling the rate of cooling of said casting within said vibratory cooling drum including adding moisture to said sand within said vibratory cooling drum responsive to a signal indicative of the moisture in said sand.

8. The casting cleaning and cooling process of claim 7 wherein said conveying step includes exhausting air from an upstream end of said cooling conveyor and blowing air onto a downstream end of said cooling conveyor.

9. The casting cleaning and cooling process of claim 8 wherein said controlling step includes exhausting air from a downstream end of said vibratory cooling drum at a point just upstream of a molding sand return port therein.

10. The casting cleaning and cooling process of claim 7 wherein said cooling rate controlling step includes generating a thermocouple signal from each of a plurality of locations within said vibratory cooling drum.

11. The casting cleaning and cooling process of claim 7 wherein said cooling rate controlling step includes adding moisture to sand within said vibratory cooling drum at each of a plurality of locations therewithin.

12. The casting cleaning and cooling process of claim 7 wherein said temperature monitoring step includes receiving an infrared signal indicative of temperature at a point just beyond said downstream end of said cooling conveyor.

13. A process for cooling and cleaning an engine casting, comprising the steps of:

removing said engine casting from a molding machine after said engine casting has been formed in said molding machine;

moving said engine casting to a punch-out station for removing said engine casting from a sand mold;

moving said engine casting to a soft shake-out station for shaking residual sand from said engine casting;

conveying said engine casting away from said soft shake-out station on a cooling conveyor.

monitoring the temperature of said engine casting at or near a downstream end of said cooling conveyor including receiving a temperature signal indicative of the temperature of said engine casting at or near said downstream end of said cooling conveyor;

transferring said engine casting from said cooling conveyor into a vibratory cooling drum for cooling said engine casting and introducing molding sand from a point upstream of said cooling conveyor into said vibratory cooling drum with said engine casting;

controlling the rate of cooling of said engine casting within said vibratory cooling drum including adding moisture to sand within said vibratory cooling drum responsive to a signal indicative of the moisture in said sand;

said cooling rate controlling step including the generating of a sand moisture signal from each of a plurality of locations within said vibratory cooling drum and adding moisture to sand within said vibratory cooling drum responsive thereto at each of a plurality of locations therewith;

said molding sand including sand from said shake-out station are conveyed to said vibratory cooling drum independently of said casting; and generating a scale signal indicative of molding sand weight downstream of said shake-out station and upstream of said vibratory cooling drum.

14. The engine casting cleaning and cooling process of claim 13 wherein said cooling rate controlling; step includes processing said scale, temperature and sand moisture signals to control moisture addition to said sand.

15. A process for cooling and cleaning an engine casting, comprising the steps of:

removing said engine casting from a molding machine after said engine casting has been formed in said molding machine;

moving said engine casting to a punch-out station for removing said engine casting from a sand mold;

moving said engine casting to a safe shake-out station for shaking residual sand from said engine casting;

conveying said engine casting away from said shake-out station on a cooling conveyor;

monitoring the temperature of said engine casting at or near a downstream end of said cooling conveyor including receiving a temperature signal indicative of the temperature of said engine casting at or near said downstream end of said cooling conveyor;

transferring said engine casting from said cooling conveyor into a vibratory cooling drum for cooling said engine while introducing molding sand collected from a point upstream of said cooling conveyor into said vibratory cooling drum with said engine casting and maintaining the molding sand in contact with sand engine casting; and controlling the rate of cooling of said engine casting within said vibratory cooling drum including adding moisture to sand within said vibratory cooling drum responsive to a signal indicative of the moisture in said sand;

said cooling rate controlling step including the generation of a sand moisture signal from each of a plurality of locations within said vibratory cooling drum and adding moisture to sand within said vibratory cooling drum responsive thereto at each of a plurality of locations therewith.

16. The engine casting cleaning and cooling process of claim 15 wherein said temperature monitoring step includes receiving an infrared signal indicative of temperature at a point just beyond said downstream end of said cooling conveyor.

17. The engine casting cleaning and cooling process of claim 15 wherein said molding sand including sand from said shake-out station are conveyed to said vibratory cooling drum independently of said casting.

18. The engine casting cleaning and cooling process of claim 15 wherein said conveying step includes exhausting air from an upstream end of said cooling conveyor and blowing air onto a downstream end of said cooling conveyor.

19. The engine casting cleaning and cooling process of claim 18 wherein said controlling step includes exhausting air from a downstream end of said vibratory cooling drum at a point just upstream of a molding sand return port therein.

20. The engine casting cleaning and cooling process of claim 15 including the step of transferring said engine casting from said vibratory cooling drum to a continuous shot blast station at a point downstream thereof.

21. A process for cooling an engine casting, comprising the steps of:

monitoring the temperature of said engine casting at or near a downstream end of a cooling conveyor including receiving a temperature signal indicative of the temperature of said engine casting thereat;

transferring said engine casting into a vibratory cooling drum for cooling said engine casting and introducing molding sand conveyed from a point upstream thereof into said vibratory cooling drum with said engine casting and maintaining said engine casting in contact with said molding sand;

controlling the rate of cooling of said engine casting within said vibratory cooling drum including adding moisture to said molding sand responsive to a signal indicative of the moisture in said sand therewithin;

said cooling rate controlling step including the generation of a sand moisture signal from each of a plurality of locations within said vibratory cooling drum and adding moisture to molding sand within said vibratory cooling drum responsive thereto at each of a plurality of locations therewithin; and removing said engine casting from said vibratory cooling drum at a temperature of approximately 130 degrees F. and removing said molding sand from said vibratory cooling drum at a temperature of approximately 120 degrees F. with a moisture content of approximately 1.5 percent.

22. A system for cooling an engine casting, comprising the steps of:

a temperature monitor for monitoring the temperature of said engine casting at or near a downstream end of a cooling conveyor and producing a temperature signal indicative of the temperature of said engine casting thereat;

a vibratory cooling drum means for cooling said engine casting and molding sand in said drum and maintaining said engine casting in contact with said molding sand; and means for controlling the rate of cooling of said engine casting within said vibratory cooling drum by adding moisture to molding sand responsive to a signal indicative of the moisture in said sand therewithin;

said cooling rate controlling means including a sand moisture signal generator at each of a plurality of locations within said vibratory cooling drum and a moisture insertion port responsive thereto at each of a plurality of locations therewithin.

23. A process for cooling and cleaning an engine casting, comprising the steps of:

removing said engine casting from a molding machine after said engine casting has been formed in said molding machine;

moving said engine casting to a punch-out station for removing said engine casting from a sand mold, said engine casting being at temperature of approximately 1250 to 1350 degrees F., and molding sand from said molding machine being at a temperature of approximately 250 degrees F. at said punch-out station;

moving said engine casting to a soft shake-out station for shaking residual sand from said engine casting;

conveying said engine casting away from said soft shake-out station on a cooling conveyor;

monitoring the temperature of said engine casting at or near a downstream end of said cooling conveyor including receiving a temperature signal indicative of the temperature of said engine casting at or near said downstream end of said cooling conveyor;

transferring said engine casting from said cooling conveyor into a vibratory cooling drum for cooling said engine casting and introducing molding sand from a point upstream of said cooling conveyor into said vibratory cooling drum with said engine casting;

controlling the :rate of cooling of said engine casting within said vibratory cooling drum including adding moisture to sand within said vibratory cooling drum responsive to a signal indicative of the moisture in said sand;

said cooling rate controlling step including the generation of a sand moisture signal from each of a plurality of locations within said vibratory cooling drum and adding moisture to sand within said vibratory cooling drum responsive thereto at each of a plurality of locations therewithin; and removing said engine casting from said vibratory cooling drum at a temperature of approximately 130 degrees F. and removing said sand from said vibratory cooling drum at a temperature of approximately 120 degrees F. with a moisture content of approximately 1.5 percent.

24. The engine casting cleaning and cooling process of claim 23 including the step of moving said engine casting to a core shake-out station at a point downstream of said cooling; conveyor and upstream of said vibratory cooling drum.

25. The engine casting cleaning and cooling process of claim 24 wherein said sand temperature at said core shake-out station is approximately 800 degrees F.

26. The engine casting cleaning and cooling process of claim 23 wherein said engine casting temperature just upstream of said vibratory cooling drum is approximately 1000 degrees F.

27. A process for cooling a casting, comprising the steps of:

monitoring the temperature of said casting following the molding thereof including receiving a temperature signal indicative of the temperature of said casting;

generating a scale signal indicative of the weight of molding sand at a point located just upstream of said vibratory cooling drum;

transferring said casting along with molding sand from the molding thereof into a vibratory cooling drum for cooling said casting and molding sand in said drum; and controlling the rate of cooling said casting within said vibratory cooling drum including adding moisture to molding sand responsive to a moisture indicative signal.

28. The casting cooling process of claim 27 wherein said controlling step includes exhausting air from a downstream end of said vibratory cooling drum at a point just upstream of a molding sand return port therein.

29. The casting cooling process of claim 27 wherein said controlling step includes generating a thermocouple signal from each of a plurality of longitudinally spaced apart locations within said vibratory cooling drum.

30. The casting cooling process of claim 27 wherein said controlling step includes adding moisture to molding sand within said vibratory cooling drum at each of a plurality of longitudinally spaced apart locations therewithin.

31. The casting cooling process of claim 27 wherein said temperature monitoring step includes receiving an infrared signal indicative of temperature at a point just upstream of said vibratory cooling drum.

32. A system for cooling a casting, comprising:

a temperature monitor for monitoring the temperature of said casting following the molding thereof and producing a temperature signal indicative of the temperature of said casting;

a signal generating scale indicative of the weight of molding sand to be introduced into said vibratory cooling drum at a point located just upstream thereof;

a vibratory cooling drum for cooling said casting and molding sand in said drum; and means for controlling the rate of cooling of said casting within said vibratory cooling drum by adding moisture to molding sand responsive to a moisture indicative sinal.

33. The casting cooling system of claim 32 wherein said controlling means includes means for exhausting air from a downstream end of said vibratory cooling drum at a point just upstream of a molding sand return port therein.

34. The casting cooling system of claim 32 wherein said controlling means includes a thermocouple signal generator at each of a plurality of longitudinally spaced apart locations within said vibratory cooling drum.

35. The casting cooling system of claim 32 wherein said controlling means includes a moisture insertion port within said vibratory cooling drum at each of a plurality of longitudinally spaced apart locations therewithin.

36. The casting cooling system of claim 32 wherein said temperature monitor produces an infrared signal indicative of the temperature of said casting at a point just upstream of said vibratory cooling drum.

37. A system for cooling and cleaning a casting, comprising:

a molding machine for forming said casting in a sand mold therewithin;

punch-out station for removing said casting from said sand mold;

a shake-out station for shaking residual sand from said casting;

a cooling conveyor for moving said casting away from said shake-out station;

a sand conveyor for conveying sand from said shake-out station;

a temperature monitor at or near a downstream end of said cooling conveyor;

a vibratory cooling drum for cooling said casting and said sand therewithin; and means for controlling the rate of cooling of said casting and sand within said vibratory cooling drum.

38. A system for cooling and cleaning an engine casting, comprising:

a molding machine for forming said casting in a sand mold therewithin;

a punch-out station for removing said engine casting from said sand-mold;

a shake-out station for shaking residual sand from said engine casting;

a cooling conveyor for moving said engine casting from said shake-out station;

a temperature monitor at or near a downstream end of said cooling conveyor for receiving a temperature signal indicative of the temperature of said engine casting;

a vibratory cooling drum means for cooling said engine casting and sand from said sand mold received from a point upstream of said cooling convey or and maintaining said engine casting in contact with said molding sand; and means for controlling the rate of cooling of said engine casting within said vibratory cooling drum by adding moisture to sand within said vibratory cooling drum responsive to a signal indicative of the moisture in said sand;

said controlling means including a sand moisture signal generator at each of a plurality of locations with said vibratory cooling drum and a moisture insertion port responsive thereto at each of a plurality of locations therewithin.

39. The engine casting cleaning and cooling system of claim 38 wherein said temperature monitor includes an infrared signal receiver indicative of temperature at a point just beyond said downstream end of said cooling conveyor.

40. The engine casting cleaning and cooling system of claim 38 including a conveyor for said molding sand including sand from said shake-out station for conveying sand to said vibratory cooling drum independently of said casting.

41. A system for cooling and cleaning an engine casting, comprising:

a molding machine for forming said casting in a sand mold therewithin;

a punch-out station for removing said engine casting from said sand mold;

a shake-out station for shaking residual sand from said engine casting;

a cooling conveyor for moving said engine casting from said shake-out station;

a sand conveyor for said molding sand including sand from said shake-out station for conveying sand to said vibratory cooling drum independently of said casting;

a scale for generating a scale signal indicative of molding sand weight downstream of said shake-out station and upstream of said vibratory cooling drum;

a temperature at or near a downstream end of said cooling conveyor for receiving a temperature signal indicative of the temperature of said engine casting;

a vibratory cooling drum for cooling said engine casting and sand from said sand mold received from a point upstream of said cooling conveyor; and means for controlling the rate of cooling of said engine casting within said vibratory cooling drum by adding moisture to sand within said vibratory cooling drum responsive to a signal indicative of the moisture in said sand;

said controlling means including a sand moisture signal generator at each of a plurality of locations within said vibratory cooling drum and a moisture insertion port responsive thereto at each of a plurality of locations therewithin.

42. The engine casting cleaning and cooling system of claim 41 wherein said cooling conveyor step includes an air exhaust at an upstream end and an air blower blowing into the cooling conveyor at a downstream end of said cooling conveyor.

43. The engine casting cleaning and cooling system of claim 42 wherein said controlling means includes an air exhaust at a downstream end of said vibratory cooling drum at a point just upstream of a molding sand return port therein.

44. The engine casting cleaning and cooling system of claim 41 including a shot blast station at a point downstream of said vibratory cooling drum.

45. The engine casting cleaning and cooling system of claim 41 wherein said controlling means includes means for processing said scale, temperature and sand moisture signals to control moisture addition to said sand.

* * * * *